United States Patent [19]

Kramer

[11] Patent Number: 4,915,394

[45] Date of Patent: Apr. 10, 1990

[54] AERIAL HOOK AND LOOP GAME

[75] Inventor: Edward F. Kramer, Manchester, N.H.

[73] Assignee: Davis, Bujold & Streck, Manchester, N.H.

[21] Appl. No.: 282,444

[22] Filed: Dec. 9, 1988

[51] Int. Cl.[4] ..... A63F 9/00

[52] U.S. Cl. ..... 273/330; 273/331; 273/343; 273/348; 273/414; 446/228

[58] Field of Search ..... 273/414, 317, 348, 329, 273/330, 331, 332, 333, 351, 343; 446/228

[56] References Cited

U.S. PATENT DOCUMENTS

| | | | |
|---|---|---|---|
| 1,352,309 | 9/1920 | Myers | 273/331 |
| 2,101,276 | 12/1937 | Walter | 273/351 X |
| 4,177,991 | 12/1979 | Meyer et al. | 273/317 |
| 4,664,389 | 5/1987 | Barclay et al. | 446/228 X |

FOREIGN PATENT DOCUMENTS

| | | | |
|---|---|---|---|
| 336915 | 3/1904 | France | 446/228 |

*Primary Examiner*—William H. Grieb

*Attorney, Agent, or Firm*—Davis, Bujold & Streck

[57] ABSTRACT

An aerial hook and loop game comprising a string extending from a fixed support to a mobile end controlled by a game player. A carriage supported on the string for free movement there along under the force of gravity and at least one target, the carriage including hooks for engaging and supporting the target for movement along the string under the influence of gravity as controlled by the configuration and tension of the string controlled by the player by means of the manipulation of the mobile end of the string, preferably by the use of an elongate stick.

10 Claims, 1 Drawing Sheet

AERIAL HOOK AND LOOP GAME

The present invention relates to an aerial hook and loop game.

It is an object to the present invention to provide an aerial hook and loop game of an entertaining nature for persons of nearly all ages and designed to develop dexterity, eye-hand coordination, spacial perception, patience and motor control.

It is a further object of the invention to provide an aerial hook and loop game which will exhibit substantially the same playing characteristics when made in a large size for use out of doors or in a relatively small size for use, for example, on a table top or inside of a car.

It is yet a further object to the present invention to provide an aerial hook and loop game with may be played without significant fear of injury by persons of all ages including children as young as three or four years old.

According to the invention there is provided an aerial hook and loop game comprising a carriage means having means by which it may be supported on an elongate flexible member for relatively free movement there along under the influence of gravity and means for engaging and supporting a target means for conveyance thereof along the elongate flexible means.

The invention will now be described, by way of example, with reference to the accompanying drawings, in which.

Figure 1:
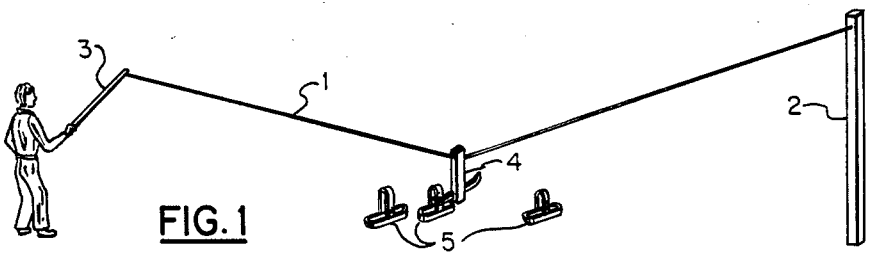
FIG. 1 is a diagrammatic representation of the aerial hook and loop game of the present invention.

With reference first to FIG. 1, the aerial hook and loop game of the present invention comprises a length of string or cable (1) attached at one end to a rigid support (2) and at its other (mobile) end to one end of a string or cable actuating wand (3) of a size to be conveniently handled and manipulated by a player of the game. The rigid support (2) may be any convenient part such as a tree or post and is not itself an element of the game except to the extent it provides for the support of one end of the string or cable (1).

Supported on the string or cable (1) is a carriage or hook member (4) designed for free movement along the string or cable under the influence of gravity as the tension and configuration of the string or cable is changed by manipulation of the wand (3). It will be appreciated that the wand (3), although preferred, is not essential to the functioning of the game and that the tension and configuration of the string or cable may be adjusted by direct action of the player of the game on the mobile end of the string or cable with which the player is associated.

A plurality of loop target members (5) are provided. These members (5) are designed to be engaged by the carriage or hook member for transportation thereby along the string or cable.

Figure 2:
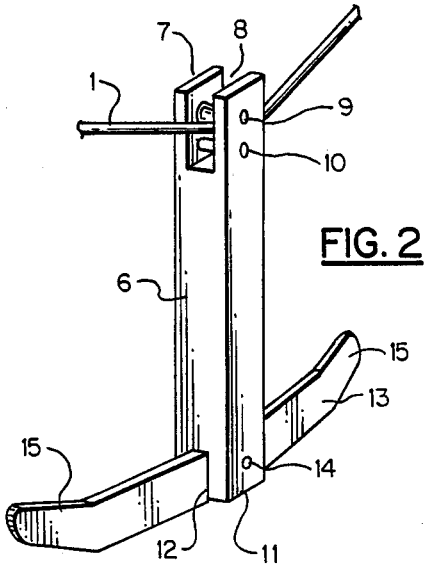
FIG. 2 is an enlarged perspective view of the traveling hook member shown in FIG. 1.

Referring now to FIG. 2, the carriage or hook member (4) consists of a post (6) in the upper end (7) of which is fashioned a slot (8) centered on and perpendicular to the end of the post. A pin or dowel (9) extends through the slot (8) transversely of the post (6) with sufficient clearance for the post to be able to move freely along a string or cable (1) extending through the slot under the pin or dowel (9). A second pin or dowel (10) may be provided below the string or cable (1) to minimize the rubbing of the string or cable on the bottom of the slot thereby minimizing friction which may otherwise inhibit free movement of the carriage or hook member (4) along the string or cable. This second pin or dowel (10) is optional. At the lower end (11) of the post (6) is a second slot (12) centered on and perpendicular to the lower end (11) of the post (6) with an orientation similar to that of the slot (8). Engaged within the slot (12) is a double ended hook (13) rigidly attached to the post (6) by a dowel (14) which passes through the post (6), slot (12) and hook (13). The hook (13) has two oppositely oriented hook ends (15) which are substantially identical to one another and which are shaped to engage a loop target member (5) and to permit the carriage or hook member to pick up and convey that target member along the string or cable. The hook (13) extends transversely off the post in a direction substantially parallel to the extension of the string or cable through the slot (8).

Figure 3:
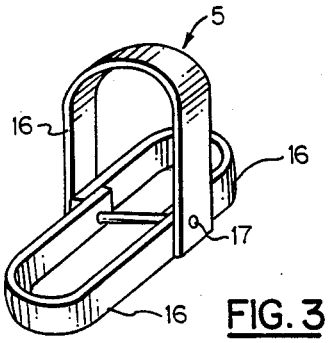
FIG. 3 is a perspective view of a loop target member shown in FIG. 1.

With reference to FIG. 3, the loop target members (5) each comprise three U-shaped loops (16) connected together adjacent the free ends of the U-shapes by a dowel (17) about which the loops can be pivoted from a folded flat configuration (not shown) for packaging and transportation to the erected shape illustrated in FIG. 3 in which the hoop target member (5) is capable of being engaged by the hook ends (15) to be picked up and conveyed by the carriage or hook member along the string or cable. The target members may be of different sizes and shapes to provide varying degrees of difficulty in achieving engagement of the hook ends with the target.

Figure 4:
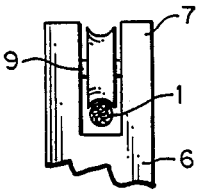
FIG. 4 is a fragmentary elevation of the upper end of a hook member showing an alternative embodiment to that shown in FIG. 2.

In the alternative embodiment of the upper end set with post (6) illustrated in FIG. 4, a pulley freely rotatable on dowel (9) and with a concave string or cable (1) engaging periphery is provided to further decrease friction between the carriage or hook member (4) and the string or cable thereby to increase the free movement of the carriage or hook member for what a string or cable (1) under the influence of gravity as the tension and configuration of the string or cable is altered by the player.

Figure 5:
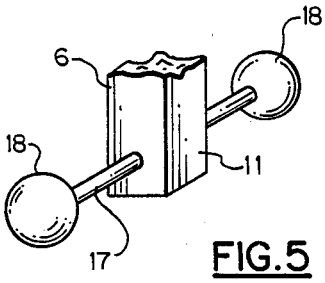
FIG. 5 is a fragmentary perspective view of the lower end of a hook member showing an alternative embodiment to that shown in FIG. 2.

FIG. 5 illustrates an alternative hook arrangement at the lower end (11) of the post (6) in which the substantially planar hook (13) illustrated in FIG. 2 is replaced by a dowel passing through a hole adjacent the lower end (11) in a direction substantially parallel to the string or cable (1). Opposite ends of the dowel (17) each carry a ball (18) to provide the means of engaging a target member (5) in a manner providing greater safety, particularly with young children, than does the hook (13). It will be appreciated that although this alternative embodiment is illustrated with balls (18) on the end of the dowel, other shaped ends may be utilized without departing from the concept of the invention.

The string or cable (1) is of sufficient strength to carry the carriage or hook member (4) and any target load that the carriage or hook member might be required to move. Further, the string or cable must be of sufficient length to span the distance to be traveled by the carriage.

In normal use, the end of the string or cable attached to the rigid support (2) is higher than the mobile end attached to the wand (3). By varying the height of the mobile end of the string relative to the fixed end and by varying the tension of the string, a player can cause the carriage or the hook member (4) to move along the string in either direction and by manipulating these parameters and the side-to-side location of the string can cause the carriage or hook member (4) to engage the target member (5) and to pick up that target member, convey it to a desired location along the string or cable (1) and to deposit that target member at a desired location.

Figure 6:
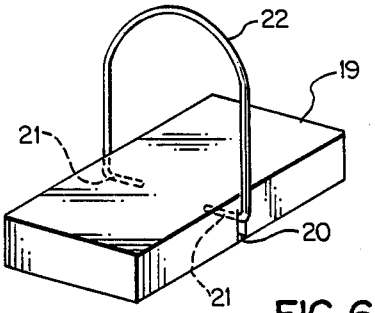
FIG. 6 is an alternative form of lop target member.

The alternative loop target member of FIG. 6 comprises a base (19) having opposed holes (not shown) associated with grooves (only one (20) being shown) to cooperate with the inwardly turned ends (21) of a wire loop (22) to captively hold the wire loop (22) upright relative to the base (19).

The parts of the game, except for the string or cable, are preferably made of wood. However, other materials such as metal or plastic could be used either alone or in any appropriate combination with each other and with wood without departing from the invention.

Although the present invention has been described with reference to the physical hooking engagement of a target member to pick it up and transport it, it will be appreciated by any man skilled in the art that other methods of engagement of the target such as the use of magnets might be utilized to provide the engagement of the carriage (4) with a target. It would also be appreciated by any man skilled in the art that while a specific form of hook member (4) and target member (5) have been described in this specific embodiment of the present invention, the actual designs and forms of these members may be widely varied without departing from the concept of the invention.

As used herein "pin means" includes a pin and a dowel.

As used herein "carriage means" includes a carriage and a hook member.

As used herein "elongate flexible member" includes a string, cable and cord of synthetic or natural materials.

I claim:

1. An aerial hook and loop game comprising an elongate carriage means having a transverse opening adjacent one end, by which it may be captively suspended on an elongate flexible member for free movement there along under the influence of gravity, and means adjacent the other end for engaging and supporting a target means for conveyance along the elongate flexible member by means of the free movement there along; a length of the elongate flexible member, having a fixable first end and a second end remote from said first end, on which the carriage means may be captively suspended for the free movement there along when the elongate flexible member is connected at its first end to a support while its second end is manipulated by a player to adjust the configuration and tension of the elongate flexible member; and said target means adapted for engagement by said engaging and supporting means for said conveyance, wherein the mobile end of the flexible elongate member is attached to one end of a wand means, said wand means providing an improved manner by which the player can manipulate the configuration and tension of the flexible elongate means and its side-to-side and vertical position.

2. An aerial hook and loop game according to claim 1 wherein the target means consists of nested, U-shaped hoops pivotally connected together adjacent free ends of the U-shapes whereby the hoops may be folded together to form a nested flat arrangement and may be unfolded to provide a target consisting of an upstanding hoop supported in its upstanding orientation by the remaining two hoops oriented oppositely to one another.

3. An aerial hook and loop game comprising a length of an elongate flexible member extending from one end attached to a fixed support to an other, mobile, end supported and controlled by a game player, an elongate carriage means pendulously supported on said elongate flexible member for free movement there along under the force of gravity and at least one target means, said carriage means including means adjacent an end thereof remote from said support for engaging and supporting said target means for conveyance along said flexible elongate means by said free movement, under the influence of gravity, as determined by the configuration and tension of the flexible elongate means controlled by the player by means of the manipulation of the mobile end of the flexible elongate member, wherein the mobile end of the flexible elongate member is attached to one end of a wand means, said wand means providing an improved manner by which the player can manipulate the configuration and tension of the flexible elongate means and its side-to-side and vertical position.

4. An aerial hook and loop game comprising a carriage means having means by which it may be supported on an elongate flexible member for relatively free movement there along under the influence of gravity and means for engaging and supporting a target means for conveyance thereof along the elongate flexible means and targets consisting of nested, U-shaped hoops pivotally connected together adjacent free ends of the U-shaped whereby the hoops may be folded together to form a nested flat arrangement and may be unfolded to provide a target consisting of an upstanding hoop supported in its upstanding orientation by the remaining two hoops oriented oppositely to one another.

5. An aerial hook and loop game according to claim 4 wherein one end of a wand means is attached to the second end of the elongate flexible member to facilitate manipulation of the tension and configuration thereof by a player.

6. An aerial hook and loop game according to claim 4 wherein the carriage means comprises an unitary elongate member and the transverse opening is a slot, defined by sides and a bottom, at one end of the elongate member with a pin means extending through that slot to provide for the captive support of the carriage means on the flexible elongate member with that member passing between the pin means and the bottom of the slot whereby said pin means facilitates the free movement.

7. An aerial hook and loop game according to claim 6 wherein a pulley is mounted for free rotation on the pin means and is provided with a concave periphery to facilitate engagement with a said elongate flexible member.

8. An aerial hook and loop game according to claim 4 wherein the engaging and supporting means is a hook member.

9. An aerial hook and loop game according to claim 8 wherein the hook means extend transversely of the elongate member to form opposed hooks each able to engage a target for conveyance along the flexible elongate member.

10. An aerial hook and loop game comprising a carriage means having means by which it may be support on an elongate flexible member for relatively free movement therealong under the influence of gravity and means for engaging and supporting a target means for conveyance therealong the elongate flexible means, wherein said target means consisting of at least one U-shaped hoop pivotally connected to a base means adjacent free ends of the U-shaped hoop whereby the U-shaped hoop may be folded with the base means to form a nested flat arrangement and may be unfolded from the base means to provide a said target means consisting of the U-shaped hoop extending substantially perpendicularly from the base means.

* * * * *